US010711658B1

(12) United States Patent
Bell et al.

(10) Patent No.: US 10,711,658 B1
(45) Date of Patent: Jul. 14, 2020

(54) TRIGGER WHEEL AND DRIVE PLATE FOR A CONCENTRIC CAMSHAFT

(71) Applicant: SCHAEFFLER TECHNOLOGIES AG & CO. KG, Herzogenaurach (DE)

(72) Inventors: Shannon Bell, Sterling Heights, MI (US); Gilson Arima, Rochester Hills, MI (US)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 0 days.

(21) Appl. No.: 16/288,159

(22) Filed: Feb. 28, 2019

(51) Int. Cl.
*F01L 1/34* (2006.01)
*F01L 1/344* (2006.01)

(52) U.S. Cl.
CPC ... *F01L 1/3442* (2013.01); *F01L 2001/34469* (2013.01); *F01L 2001/34483* (2013.01); *F01L 2101/00* (2013.01)

(58) Field of Classification Search
CPC ..... F01L 1/3442; F01L 2001/34469; F01L 2001/34483; F01L 2101/00
See application file for complete search history.

(56) References Cited

U.S. PATENT DOCUMENTS

| | | | | |
|---|---|---|---|---|
| 8,113,159 | B2 | 2/2012 | Myers et al. | |
| 8,336,512 | B2 | 12/2012 | Myers et al. | |
| 8,375,906 | B2 | 2/2013 | Myers et al. | |
| 2007/0277757 | A1* | 12/2007 | Fischer | F01L 1/022 123/90.17 |
| 2010/0089353 | A1 | 4/2010 | Myers et al. | |
| 2010/0186700 | A1* | 7/2010 | Kandolf | F01L 1/3442 123/90.17 |

* cited by examiner

*Primary Examiner* — Zelalem Eshete
(74) *Attorney, Agent, or Firm* — Brooks Kushman P.C.

(57) ABSTRACT

A camshaft phaser or camshaft adjuster for an internal combustion engine is disclosed. The camshaft adjuster includes a rotor, and a stator disposed about the rotor in a slideable engagement such that the stator and the rotor are rotatable relative to each other. A trigger wheel is configured to interact with an associated sensor for detection of an angular speed or position of the trigger wheel. A drive plate is configured to be non-rotatably fixed with an inner camshaft and rotatably coupled to the trigger wheel. In various embodiments, the trigger wheel has an axial face that defines an opening, and the drive plate has a tab with an axially-extending portion extending through the opening in the trigger wheel.

20 Claims, 5 Drawing Sheets

TRIGGER WHEEL AND DRIVE PLATE FOR A CONCENTRIC CAMSHAFT

TECHNICAL FIELD

The present disclosure relates to a camshaft adjuster or phaser for adjusting the phase position of a camshaft relative to a crankshaft of an internal combustion engine.

BACKGROUND

Camshaft phasers are utilized within internal combustion (IC) engines to adjust timing of an engine valve event to modify performance, efficiency and emissions. Hydraulically actuated camshaft phasers can be configured with a rotor and stator arrangement. The rotor can be attached to a camshaft and actuated hydraulically in clockwise or counterclockwise directions relative to the stator, which is rotationally connected to a crankshaft, to achieve variable engine valve timing.

Camshaft phasers can be applied to concentric camshaft assemblies that include an inner camshaft and an outer camshaft. The inner and outer camshafts can be arranged to actuate separate groups of intake and exhaust valves and facilitate phasing of one set of valves relative to the other with the use of a camshaft phaser.

SUMMARY

In one embodiment, a camshaft phaser or adjuster is provided for an internal combustion engine. The camshaft adjuster includes a rotor, and a stator disposed about the rotor in a slideable engagement such that the stator and the rotor are rotatable relative to each other. A trigger wheel is configured to interact with an associated sensor for detection of an angular speed or position of the trigger wheel. The trigger wheel has an axial face that defines an opening. A drive plate is configured to be non-rotatably fixed with an inner camshaft and rotatably coupled to the trigger wheel. The drive plate has a tab with an axially-extending portion extending through the opening in the trigger wheel.

In another embodiment, a camshaft adjuster includes a stator disposed about an axis. A rotor is disposed about the axis and is slidably engaged with the stator, wherein the rotor is moveable relative to the stator via hydraulic actuation. A trigger wheel is configured to interact with an associated sensor for detection of an angular speed or position of the trigger wheel, and the trigger wheel defines an opening. A drive plate has a tab extending through the opening and non-rotatably fixed to the stator.

In another embodiment, a camshaft adjuster for a concentric camshaft assembly having inner and outer camshafts of an internal combustion is provided. The camshaft adjuster includes a stator configured to be non-rotatably fixed with the inner camshaft. A rotor is located within the stator and is configured to be connected to the outer camshaft. The camshaft adjuster also includes a trigger wheel, and a drive plate configured to be non-rotatably fixed with the inner camshaft and the stator. The drive plate has a plurality of tabs extending axially entirely through the trigger wheel.

DETAILED DESCRIPTION

Figure 1:
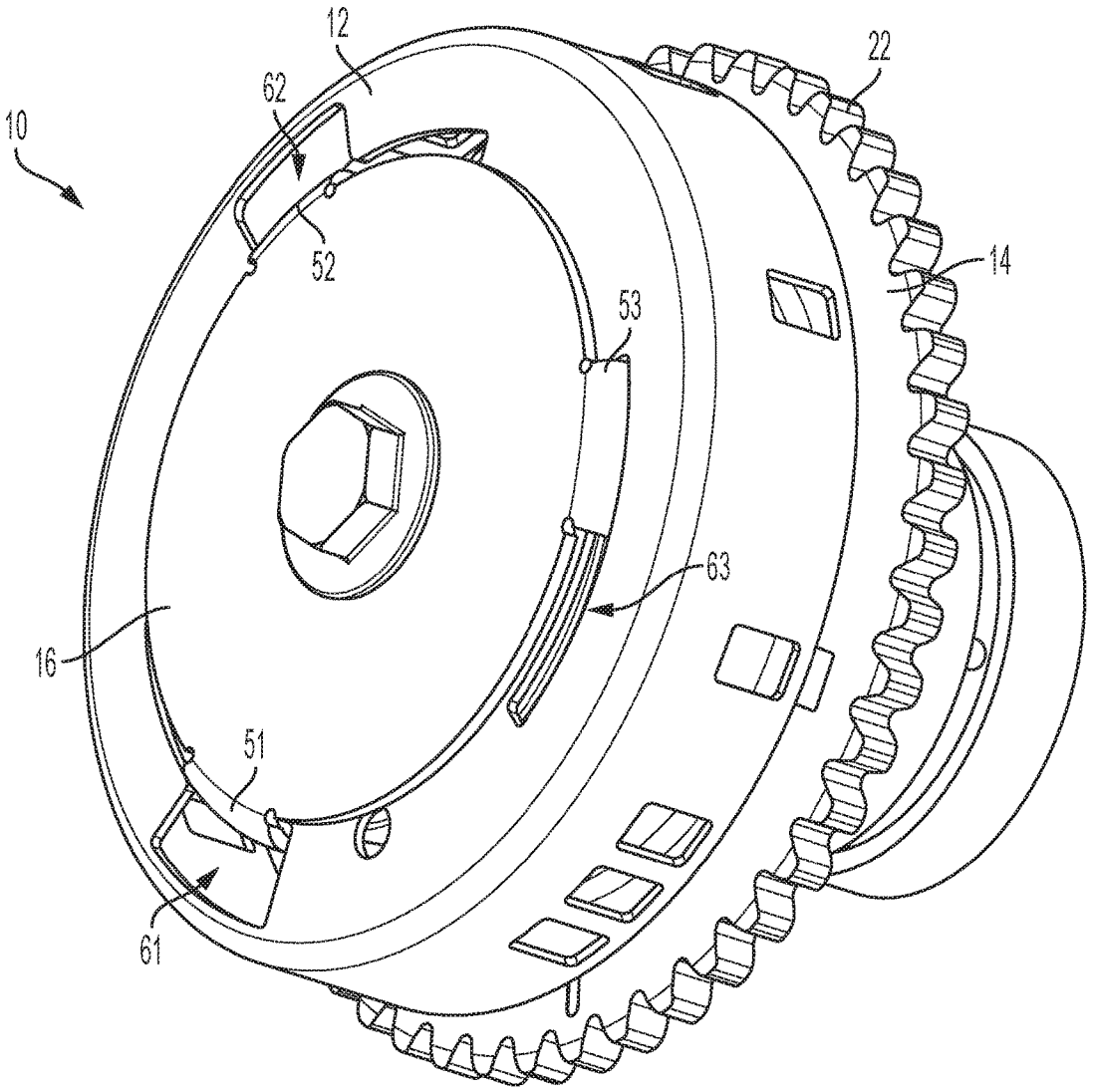
FIG. 1 is a perspective view of a camshaft adjuster, according to one embodiment.

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Directional terms used herein are made with reference to the views and orientations shown in the exemplary figures. A central axis is shown in the figures and described below. Terms such as "outer" and "inner" are relative to the central axis. For example, an "outer" surface means that the surface faces away from the central axis, or is outboard of another "inner" surface. Terms such as "radial," "diameter," "circumference," etc. also are relative to the central axis. The terms "front," "rear," "upper" and "lower" designate directions in the drawings to which reference is made.

Camshafts are used in internal combustion engines in order to actuate the gas exchange valves. The camshaft in an internal combustion engine includes a plurality of cams that engage cam followers (i.e. bucket tappets, finger levers or rocker arms). When the camshaft rotates, the cams lift the cam followers which in turn actuate gas exchange valves (intake, exhaust). The position and the shape of the cams define the opening period and amplitude as well as the opening and closing time of the gas exchange valves.

Concentric camshaft assemblies include separate intake and exhaust camshafts concentrically arranged. A hollow outer camshaft can at least partially surround an inner camshaft, with the inner camshaft cam lobes being rotatable on the outer camshaft and connected through slots in the hollow outer camshaft to the inner camshaft. This allows the use of separate camshafts for intake and exhaust valve actuation within generally the same space required for a single camshaft. One of the camshafts can be actuated (e.g., by hydraulics) to rotate relative to a crankshaft (or relative to the other camshaft that is rotationally fixed to the crankshaft) so that the timing of the various valves being opened can be correspondingly adjusted.

A camshaft position sensor may interface with a trigger wheel located on the camshaft assembly. As the trigger wheel passes by the camshaft position sensor, the sensor can detect the position of the trigger wheel and therefore the camshaft(s) that is connected to the trigger wheel. Packaging constraints, cost of materials, and other factors may require the trigger wheel to be as unnoticeable as possible so as to not interfere with other components of the concentric camshaft adjuster.

Figure 2:
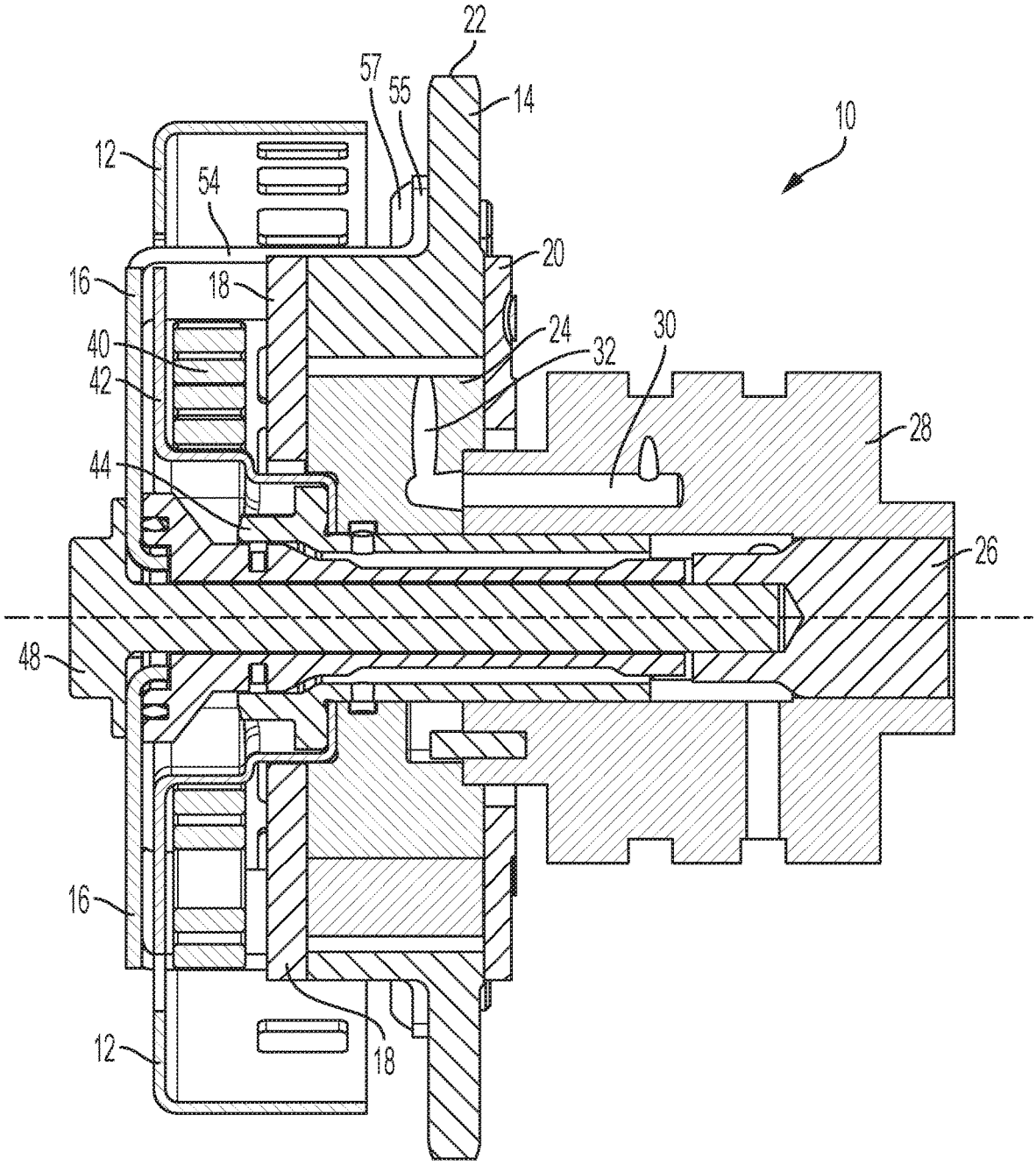
FIG. 2 is a cross-sectional view through the camshaft adjuster of FIG. 1.
Figure 3:
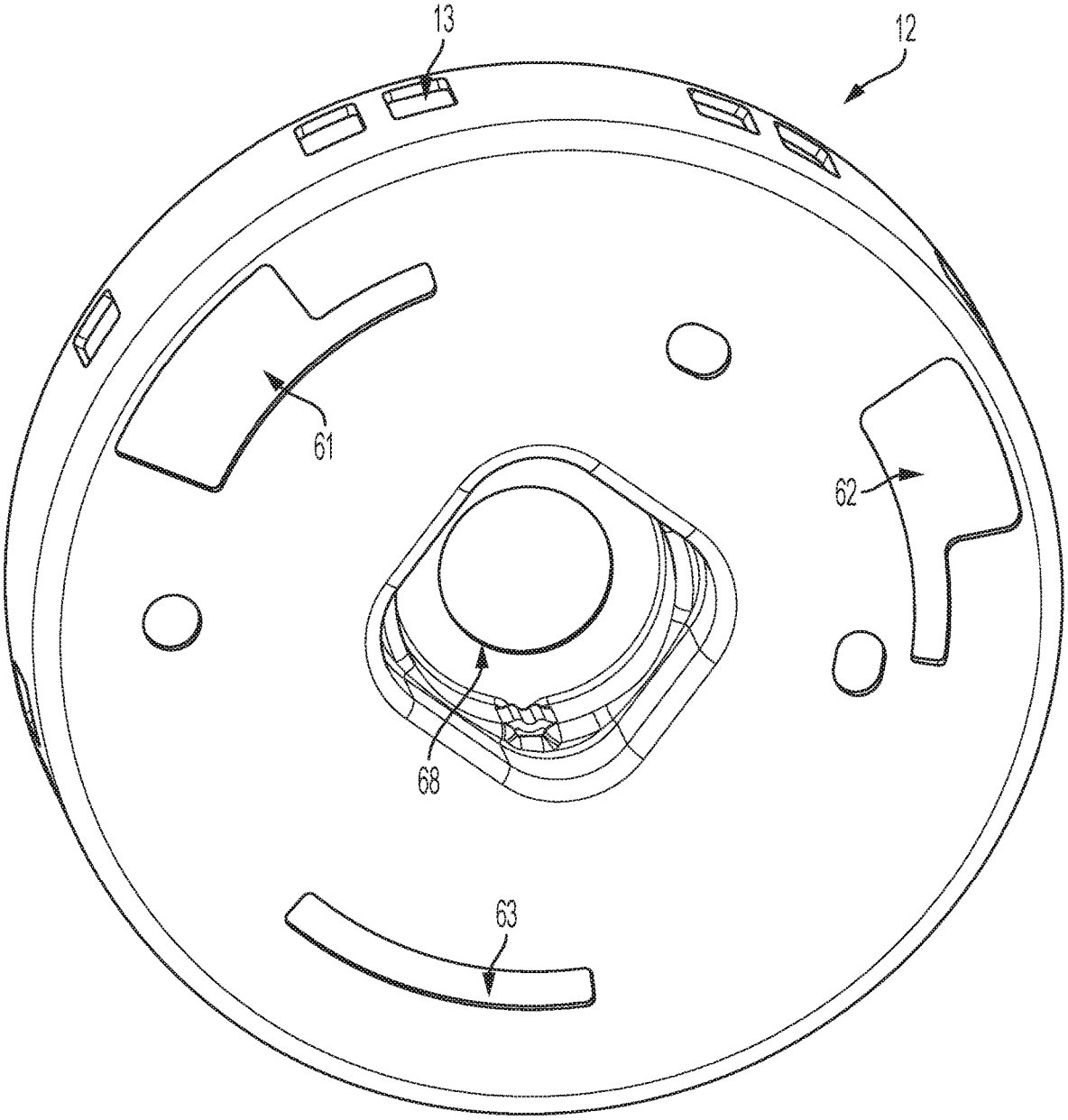
FIG. 3 is a perspective view of a trigger wheel of a camshaft adjuster, according to one embodiment.
Figure 4:
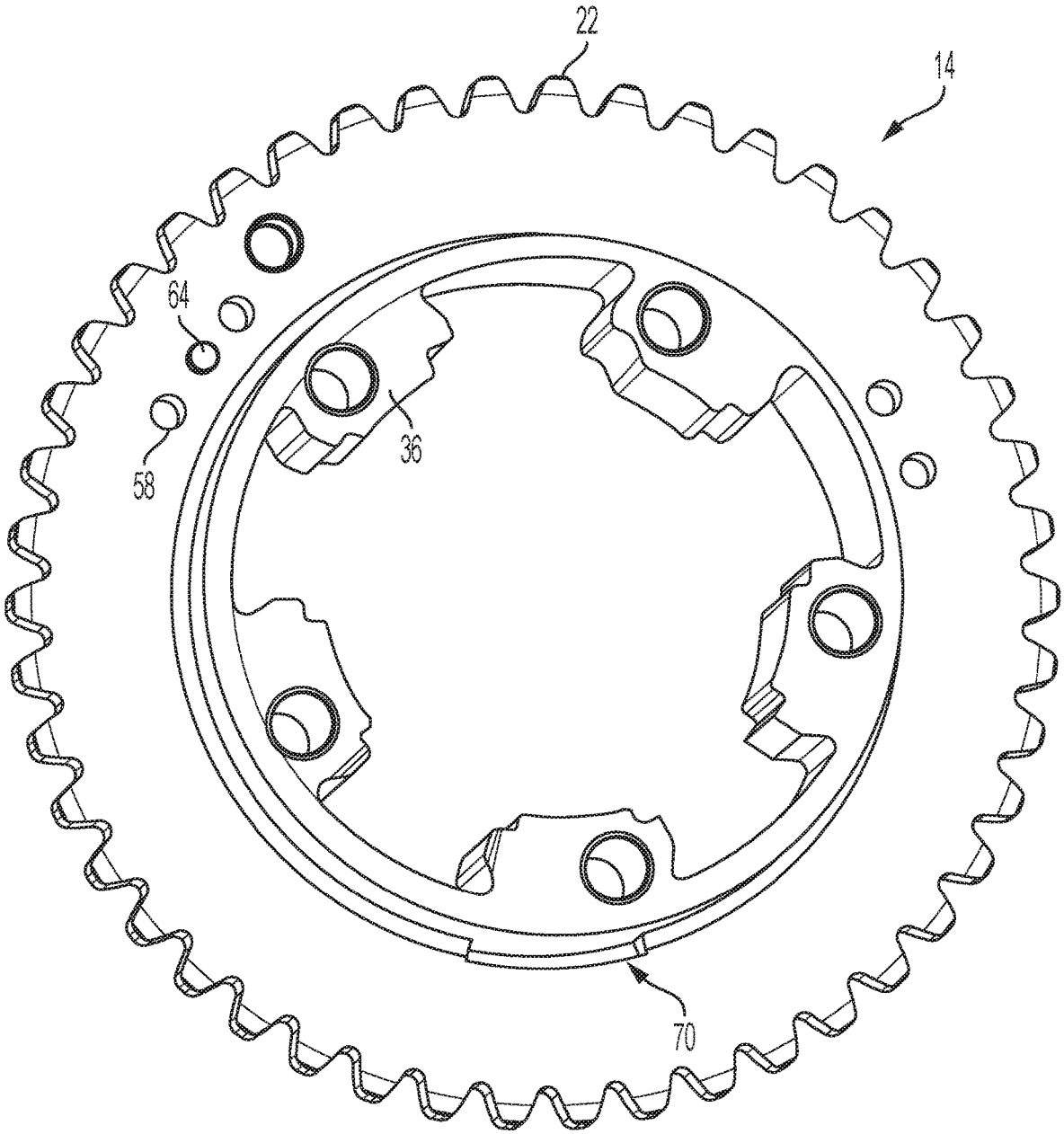
FIG. 4 is a perspective view of a stator or sprocket of a camshaft adjuster, according to one embodiment.
Figure 5:
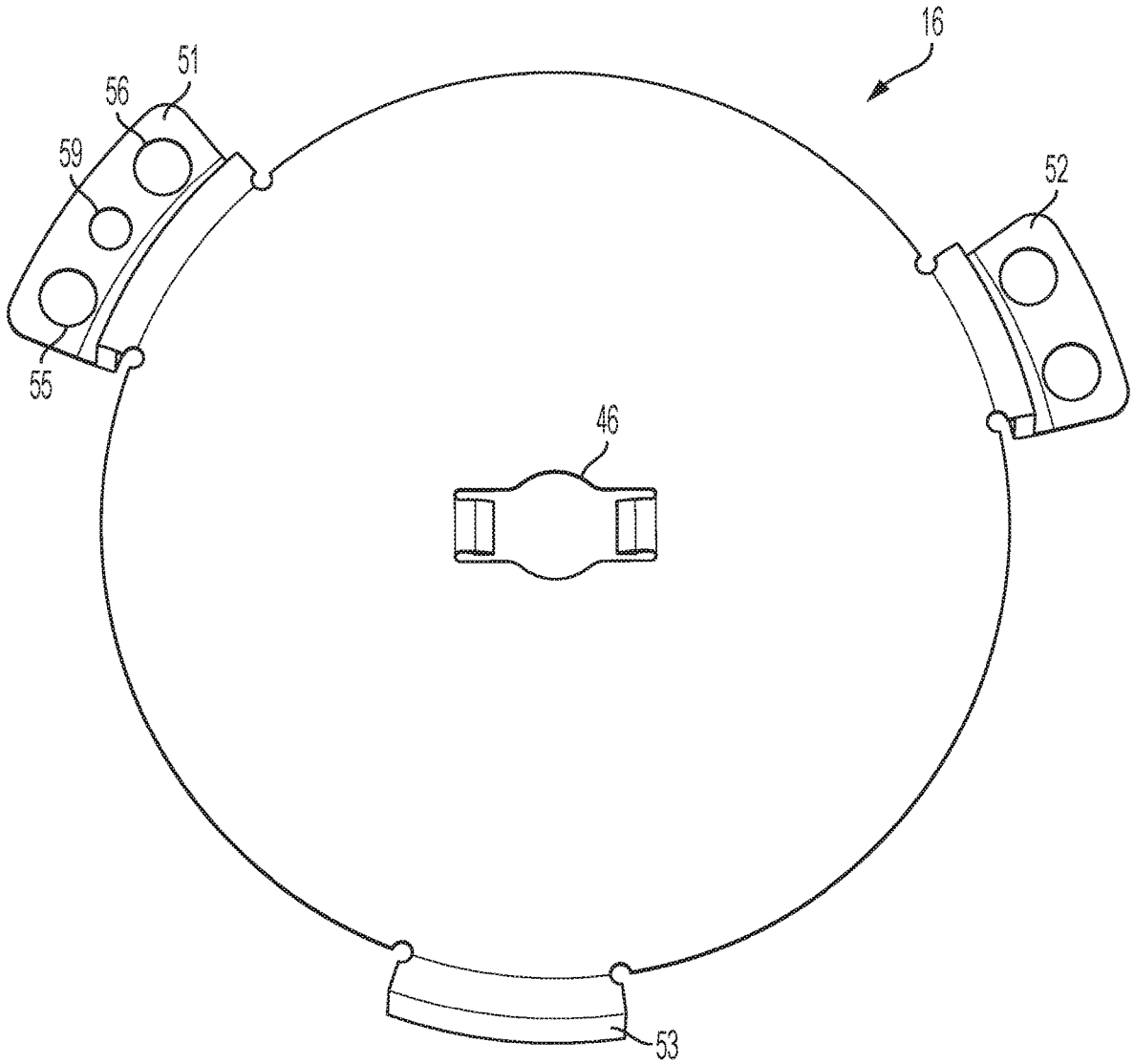
FIG. 5 is front view of a drive plate of a camshaft adjuster, according to one embodiment.

Therefore, according to embodiments described below and illustrated in the accompanying Figures, a camshaft adjuster is provided with both a trigger wheel and drive plate in a single camshaft adjuster. This is possible with the below description of a new structure, engagement, interaction, and packaging of components within the camshaft adjuster, according to an embodiment. FIG. 1 shows a perspective view of an assembled camshaft adjuster according to one embodiment, and FIG. 2 shows that camshaft adjuster in a cross-sectional view. FIGS. 3-5 show various components of the camshaft adjuster in isolation; FIG. 3 shows the trigger wheel in isolation, FIG. 4 shows the stator or sprocket in isolation, and FIG. 5 shows the drive plate in isolation.

Referring to FIGS. 1-5, a camshaft adjuster 10 (also referred to as a camshaft phaser or a cam phaser) according to one embodiment is illustrated. The camshaft adjuster 10 can also be referred to as a concentric camshaft adjuster or camshaft phaser. The camshaft adjuster 10 operates to adjust the camshafts relative to one another to alter the variable valve timing of an internal combustion engine.

The camshaft adjuster 10 is shown in perspective view in FIG. 1, and in cross-sectional view in FIG. 2. The camshaft adjuster 10 includes a trigger wheel 12 (shown in isolation in FIG. 3), a stator or sprocket 14 (shown in isolation in FIG. 4), and a drive plate 16 (shown in isolation in FIG. 5).

The camshaft adjuster 10 is configured to advance or retard a camshaft of an engine in order to vary valve timing. In embodiments, the camshaft adjuster 10 includes a front sidewall 18 and a rear sidewall 20, with the stator 14 located axially therebetween. The stator 14 can include sprocket teeth 22 extending outwardly therefrom to engage and turn a chain or belt. Due to the presence of the trigger wheel 12 (explained below), in embodiments the stator 14 does not include a separate timing gear or timing wheel. A rotor 24 is disposed between the sidewalls 18, 20 and radially inward of the stator 14. An inner camshaft 26 is disposed within an outer camshaft 28. Therefore, the camshaft adjuster 10 can be referred to as a concentric camshaft adjuster.

The camshaft adjuster 10 is configured to rotate one of the camshafts 26, 28 relative to the other camshaft 26, 28 to alter valve timing. This may be done via hydraulic actuation. For example, various fluid passageways may be provided that, when provided with pressurized fluid, cause relative movement of parts within the camshaft adjuster 10. In one embodiment, the outer camshaft 28 may be provided with a first pressure chamber 30 that is in fluid communication with a second pressure chamber 32 defined within the rotor 24. By pressurizing the fluid chambers 30, 32, the rotor 24 is rotated by the pressurized fluid acting on vanes or other passages within the camshaft adjuster 10 to either advance or retard a position of the rotor 24 (and therefore the outer camshaft 28 connected thereto) relative to the stator 14, the inner camshaft 26, and a crankshaft (not shown). Additional or alternate fluid passages may be provided for moving one of the camshafts relative to the other, and the illustration in these Figures is merely one example of performing hydraulic actuation of the camshaft adjuster 10.

The pressurized hydraulic fluid may be provided to the fluid passages in a known manner via oil passages in or between the inner and outer camshafts 26, 28, which are fed by oil passages in a camshaft bearing journal support. An engine control unit (ECU) controlled flow valve (not shown) can be used to control the flow of pressurized hydraulic fluid to one or more of the fluid passages.

The stator 14 may be slidingly engaged with the rotor 24, allowing loads to be radially transferred from the stator 14 to the rotor 24. The engagement between the stator 14 and the rotor 24 may include inwardly-directed projections 36 having an inner surface that contacts an outer surface of the rotor 24.

In one embodiment, the camshaft adjuster 10 also includes a tension equalization spring 40. The spring 40 may be a helical spring. The spring 40 is connected to the rotor 24 by a spring cover 42 (which may be part of the trigger wheel 12, as described below) which is pressed against the rotor 24 by a hollow bolt 44. The spring 40 is configured to equalize the force required to advance the rotor 24 relative to the stator 14 in comparison to the force required to retard the position of the rotor 24 relative to the stator 14.

The drive plate 16 acts as a front cover to the camshaft adjuster 10. The drive plate 16 includes a central opening 46 sized and configured to receive a central fastener 48, which also passes through a central opening 68 of the trigger wheel 12. The central fastener 48 may be a bolt or the like, and passes through the center of the camshaft adjuster 10 and engages the inner camshaft 26. This fixes the drive plate 16 with the inner camshaft 26.

The trigger wheel 12 is disposed about several components of the camshaft adjuster 10. The trigger wheel 12 is configured to interact with a sensor (not shown) for detection of the precise angular position of the trigger wheel 12 and the components non-rotatably connected thereto. For example, the trigger wheel 12 can have a plurality of apertures 13 that pass by a corresponding sensor (not shown) such that when a particular one of the apertures 13 passes by the sensor, the angular position of the trigger wheel is detectable. The sensor and its corresponding controller may be configured to recognize patterns of apertures 13 as they pass by the sensor to know the angular position of the trigger wheel 12. The trigger wheel 12 may include the spring cover 42 described above, and may be connected to the hollow bolt 44 and therefore the rotor 24. Therefore, the detected angle of the trigger wheel 12 informs the ECU of the angle of the trigger wheel 12 (and connected rotor 24) relative to the stator 14.

The camshaft adjuster 10 is provided with both the trigger wheel 12 and the drive plate 16. The trigger wheel 12 and the drive plate 16 are assembled to one another in such a manner that packaging constraints are maintained. To accomplish this, the drive plate 16 may be provided with a plurality of tabs. For example, the drive plate 16 can have a first tab 51, a second tab 52, and a third tab 53. The trigger wheel 12 may be provided with a corresponding plurality of apertures or openings, such as a first opening 61, a second opening 62, and a third opening 63, on an axial face of the trigger wheel. The openings 61, 62, 63 are each sized and configured to receive a corresponding one of the tabs 51, 52, 53. This allows a portion of the drive plate 16 to pass through the trigger wheel 12 in the axial direction, whereupon at least one of the tabs may be fixed to the stator 14.

For example, the first tab 51 may be bent axially to have an axially-extending portion 54, and then bent again to have a radially-extending portion 55. The radially-extending portion 55 may act as a flange, and may define one or more openings 56 configured to receive a fastener 57 to fasten the tab 51 to the stator 14. The stator 14 may have corresponding openings 58 configured to receive the fastener 57. The second tab 52 may be provided with similar structure to fix the tab 52 to the stator 14, which may be provided with additional apertures to receive fasteners. One or more additional apertures, such as aperture 59, may be provided to receive a locating tab or projection 64 extending axially out from the stator 14.

The third tab 53 may not include a radially-extending flange, but may instead extend through the stator 14. For example, the stator 14 may be provided with a pocket 70 configured to receive the third tab 53. The pocket 70 may be an aperture that extends entirely through the stator 14. Alternatively, the pocket 70 may be a groove or indentation that does not pass entirely through the stator 14. The third tab 53 may be connected within the pocket 70 via a press fit, interference fit, or other such connection methods so that rotational force from the third tab 53 turns the stator 14, and vice versa.

The openings 61, 62, 63 in the trigger wheel 12 may extend circumferentially further than the corresponding tabs 51, 52, 53. This allows for relative circumferential movement between the drive plate 16 and the trigger wheel 12 during actuation of the camshaft adjuster 10 via the hydraulic pressure. Stated otherwise, the openings 61, 62, 63 may accommodate a rotational range of authority of the camshaft phaser 10.

While not illustrated herein, another embodiment may be provided in which the tabs that extend from the drive plate are each designed similar to the third tab 53. In other words, the tabs 51, 52, 53 may extend axially into a corresponding pocket within the stator 14. This would remove the need for fasteners 57 while still maintaining the connection between the drive plate 16 and the stator 14 such that torque can transmit therebetween.

Also, while three tabs 51-53 are illustrated, more or less than three tabs may be utilized, depending on the force distribution requirements between the drive plate 16 and the stator 14, for example.

It should be understood that while the embodiment shown herein utilizes hydraulic actuation to move the outer camshaft and rotor relative to the inner camshaft which is fixed with the stator, other embodiments are contemplated in which hydraulic actuation actuates the inner camshaft and rotor relative to the stator and outer camshaft. Alteration of the location of the fluid passages or hydraulic chambers, as well as the location and interconnections of the components within the camshaft adjuster, can make this possible.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

PARTS LIST

The following is a list of reference numbers shown in the Figures. However, it should be understood that the use of these terms is for illustrative purposes only with respect to one embodiment. And, use of reference numbers correlating a certain term that is both illustrated in the Figures and present in the claims is not intended to limit the claims to only cover the illustrated embodiment.

10 camshaft adjuster
12 trigger wheel
13 aperture
14 stator or sprocket
16 drive plate
18 front sidewall
20 rear sidewall
22 teeth
24 rotor
26 inner camshaft
28 outer camshaft
30 first pressure chamber
32 second fluid chamber
36 projections
40 spring
42 spring cover
44 hollow bolt
46 central opening
48 central fastener
51 first tab
52 second tab
53 third tab
54 axially-extending portion
55 radially-extending portion
56 opening
57 fastener
58 opening
59 aperture
61 opening
62 opening
63 opening
64 locating tab or projection
68 central opening
70 pocket

What is claimed is:

1. A camshaft adjuster for an internal combustion engine, the camshaft adjuster comprising:

a rotor;

a stator disposed about the rotor in a slideable engagement such that the stator and rotor are rotatable relative to each other;

a trigger wheel configured to interact with an associated sensor for detection of an angular speed or position of the trigger wheel, wherein the trigger wheel has an axial face that defines an opening; and a drive plate configured to be non-rotatably fixed with an inner camshaft and rotatable relative to the trigger wheel, wherein the drive plate has a tab with an axially-extending portion extending through the opening in the trigger wheel.

2. The camshaft adjuster of claim 1, wherein the opening in the trigger wheel is circumferentially larger than the tab to enable relative rotation between the trigger wheel and the drive plate.

3. The camshaft adjuster of claim 1, wherein the tab extends entirely through the trigger wheel.

4. The camshaft adjuster of claim 1, wherein the tab is fixed to the stator.

5. The camshaft adjuster of claim 4, wherein the tab includes a radially-extending portion that is fastened to the stator.

6. The camshaft adjuster of claim 4, wherein the stator includes a pocket and the tab is fitted within the pocket.

7. The camshaft adjuster of claim 1, wherein the tab is a first tab, the opening is a first opening, the drive plate includes a second tab, and the trigger wheel includes a second opening that receives the second tab.

8. The camshaft adjuster of claim 7, wherein the first tab has a radially-extending portion fastened to the stator, and the second tab is disposed within a pocket defined in the stator.

9. A camshaft adjuster comprising:

a stator disposed about an axis;

a rotor disposed about the axis and slidably engaged with the stator, wherein the rotor is moveable relative to the stator via hydraulic actuation;

a trigger wheel configured to interact with an associated sensor for detection of an angular speed or position of the trigger wheel, the trigger wheel defining an opening; and a drive plate having a tab extending through the opening and non-rotatably fixed to the stator.

10. The camshaft adjuster of claim 9, wherein the tab includes an axially-extending portion and a radially-extending portion, the radially-extending portion fixed to the stator via a fastener.

11. The camshaft adjuster of claim 9, wherein the stator has an axial surface that defines a pocket, and wherein the tab includes an axially-extending portion extending entirely through the trigger wheel and into the pocket.

12. The camshaft adjuster of claim 11, wherein the pocket is an aperture extending entirely through the stator.

13. The camshaft adjuster of claim 9, wherein the opening in the trigger wheel is circumferentially larger than the tab to enable relative rotation between the drive plate and the trigger wheel.

14. The camshaft adjuster of claim 9, further comprising an inner camshaft non-rotatably fixed with the drive plate, and an outer camshaft rotatably disposed about the inner camshaft.

15. The camshaft adjuster of claim 9, wherein the stator does not include a timing gear configured to interact with a sensor for detection of an angular position or timing of the stator.

16. A camshaft adjuster for a concentric camshaft assembly having inner and outer camshafts of an internal combustion engine, the camshaft adjuster comprising:

a stator configured to be non-rotatably fixed with the inner camshaft;

a rotor located within the stator and configured to be connected to the outer camshaft;

a trigger wheel; and a drive plate configured to be non-rotatably fixed with the inner camshaft and the stator, the drive plate having a plurality of tabs extending axially entirely through the trigger wheel.

17. The camshaft adjuster of claim 16, wherein the plurality of tabs include a first tab and a second tab, wherein the first tab is connected to the stator via a fastener.

18. The camshaft of claim 16, wherein the plurality of tabs include a first tab and a second tab, wherein the first tab extends into a pocket of the stator.

19. The camshaft of claim 16, wherein the trigger wheel includes a first central aperture, the drive plate includes a second central aperture, and the camshaft adjuster includes a central fastener extending through the first and second apertures.

20. The camshaft adjuster of claim 16, wherein at least some of the plurality of tabs include:

an axially-extending portion extending through the stator, and a radially-extending portion fixed to the stator via a fastener.

* * * * *